United States Patent [19]

Randall et al.

[11] 4,064,653

[45] Dec. 27, 1977

[54] SLIDING WINDOW

[75] Inventors: Robert P. Randall, Clinton; Richard L. Torbett, Mars, both of Pa.

[73] Assignee: Three Rivers Aluminum Company, Pittsburgh, Pa.

[21] Appl. No.: 737,089

[22] Filed: Oct. 29, 1976

[51] Int. Cl.[2] ..... E05D 15/08

[52] U.S. Cl. ..... 49/458; 49/DIG. 1

[58] Field of Search ..... 49/458, 425, DIG. 1, 49/472–474, 453, 457

[56] References Cited

U.S. PATENT DOCUMENTS

| | | | |
|---|---|---|---|
| 1,845,985 | 2/1932 | Plym | 49/473 |
| 3,420,026 | 1/1969 | Nolan | 49/DIG. 1 |

*Primary Examiner*—Kenneth Downey

*Attorney, Agent, or Firm*—Brown, Murray, Flick & Peckham

[57] ABSTRACT

A pair of sliding window sashes have overlapping ends, each of which includes a vertical sash rail to which a vertical metal bar is joined between the rail and the other sash. Each bar has a pair of vertical slots in it separated by a vertical flange and facing the opposite end of the sash that carries the bar with the outer side wall of the outer slot forming a tongue extending into the outer slot in the other bar to interlock the two bars while the window is closed. The inner side wall of each groove extends outwardly beyond that groove toward the opposite end of the sash to form a vertical flange. A vertical sealing weather strip is connected to the side of each bar opposite its slots and engages the flange on the other bar to form a seal.

7 Claims, 5 Drawing Figures

SLIDING WINDOW

It is among the objects of this invention to provide a sliding window, which is interlocked when the two sashes are closed, and which is sealed against wind and water passing between the overlapping portions of the closed window.

The preferred embodiment of the invention is illustrated in the accompanying drawings, in which.

Figure 1:
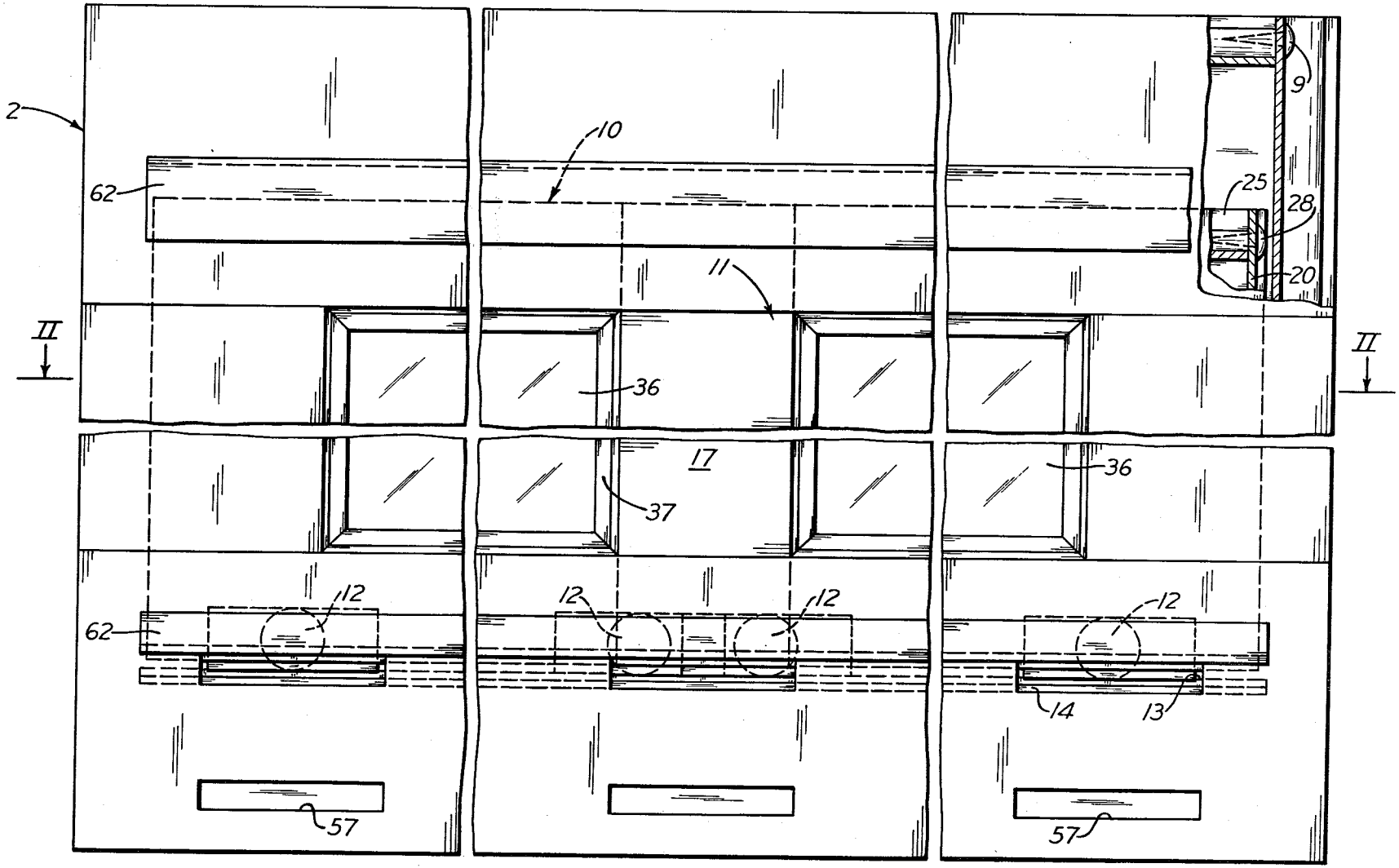
FIG. 1 is a fragmentary view of the outside of the window, with parts broken away in section.
Figure 2:
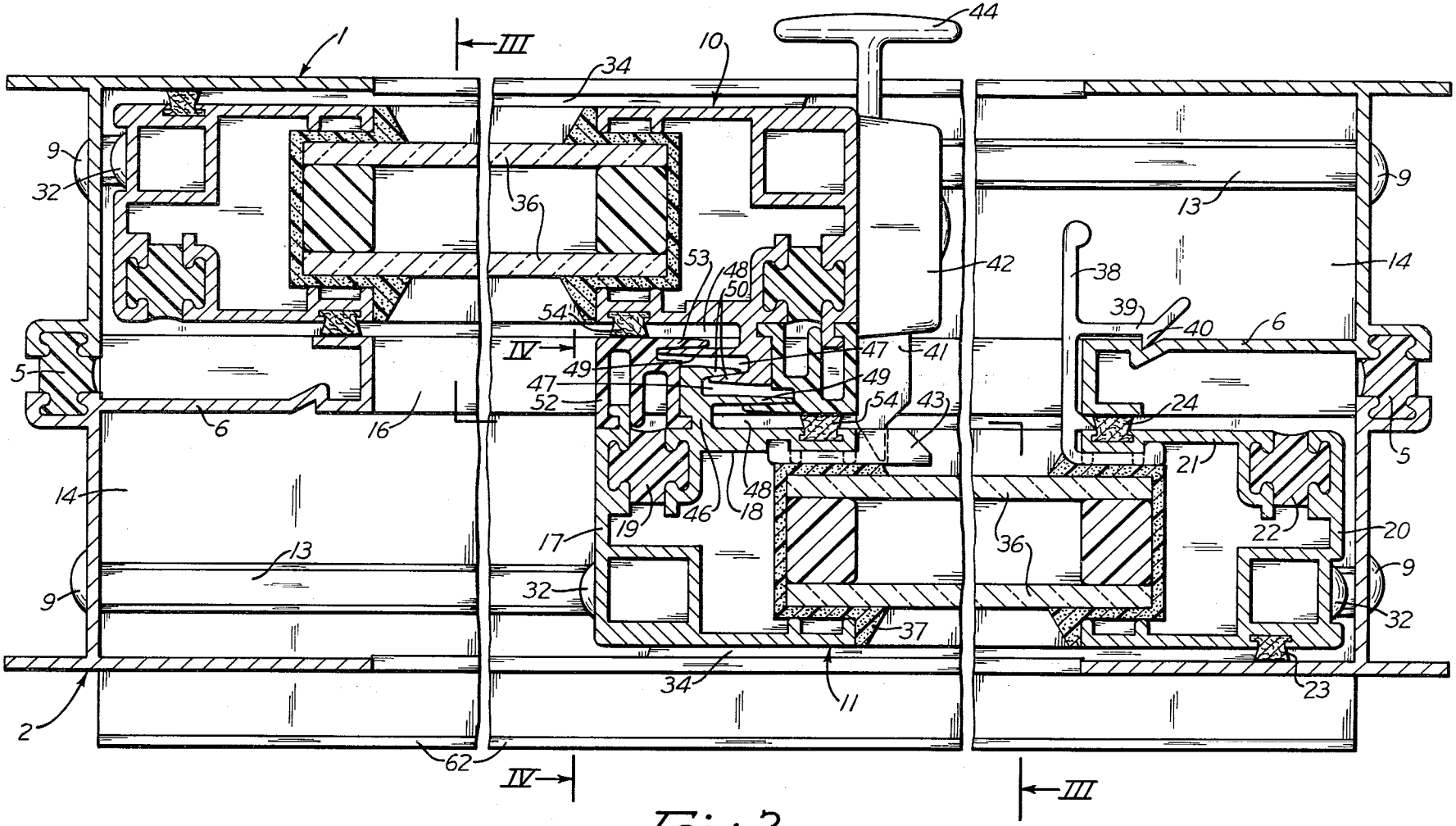
FIG. 2 is a fragmentary horizontal section taken on the line II—II of FIG. 1.

Referring to the drawings, a sliding window is formed from two rectangular window frames 1 and 2 disposed one behind the other, with a metal window sash movable horizontally in each frame. The two metal frames are rigidly connected together top and bottom by rigid vinyl plastic bars 3 and 4 inserted in grooves and thermally insulating the frames from each other. The ends of the frames are connected in the same way by vertical rigid vinyl plastic bars 5. As shown in FIG. 2, one end of each frame has an inwardly extending vertical flange 6, the inner end of which extends across the gap between the frames and then extends a short distance back toward the adjoining end of the frame. The inner sides of the frames have parallel flanges 7 at the top extending downwardly. Connected to thin lower edges is a hollow vinyl plastic bar 8 that forms the top of the opening between the two frames and also serves as part of the inner walls of downwardly opening sash-receiving channels in the upper parts of the window frames. The end members of the frames are secured to the top and bottom members by screws 9.

Figure 3:
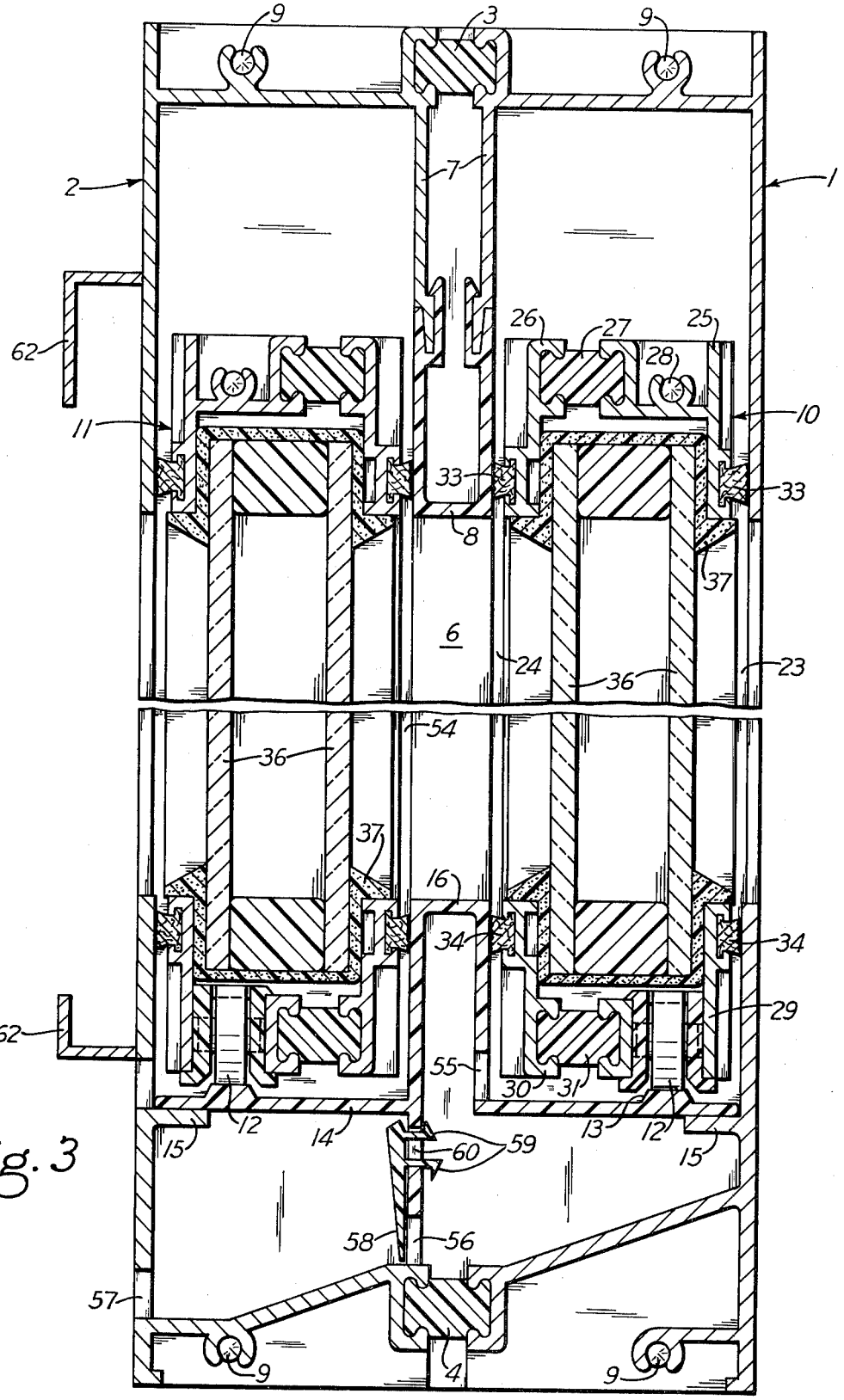
FIGS. 3 and 4 are vertical sections taken on the lines III—III and IV—IV, respectively, of FIG. 2.
Figure 5:
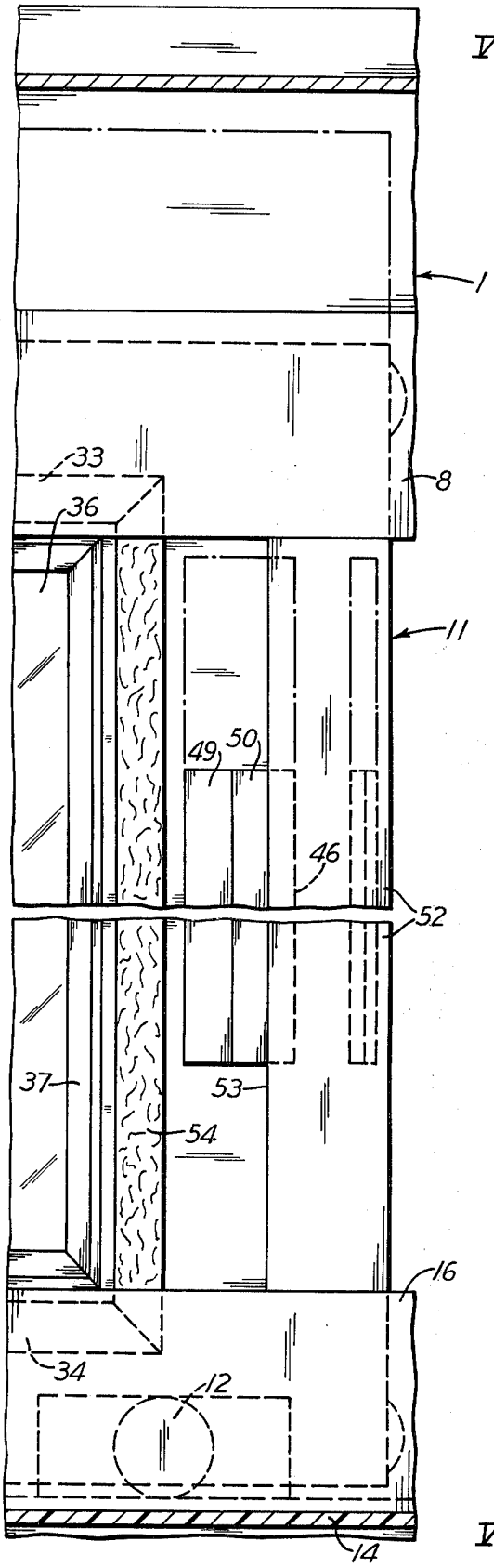
FIG. 5 is a fragmentary view of the inside of the outer sash, taken on the line V—V of FIG. 4.

The frames are of such length that the left-hand end of one sash overlaps the right-hand end of the other sash when the window is closed. Sash 10 mounted in frame 1, which is the inner frame, is called the inner sash. The other sash, sash 11, is the outer sash. Either sash can be moved from its closed position towards the opposite end of its frame to open the window. Preferably, the bottoms of the sashes are provided with rollers 12 that travel on raised tracks 13 beneath the sashes as shown in FIG. 3. The tracks are formed on a sash-supporting sill member 14, preferably made of a vinyl plastic, that rests on ledges 15 in the frames and on the bottom of the outer frame. The central portion 16 of sill member 14 extends upwardly between the sashes so that bottom channels are formed that receive the bottoms of the sashes. The upper channels are deeper than the lower channels.

Each metal sash has vertical end rails at its ends in the form of vertical channels. As shown in FIG. 2, the overlapping end rails are each formed from two metal parts 17 and 18 connected together by a rigid vinyl plastic thermal insulating bar 19 inserted in grooves in the two metal parts. The opposite or outer end rails likewise are each formed from two metal parts 20 and 21 rigidly connected by a rigid vinyl plastic bar 22. When the window is closed, these outer end rails are disposed in the end channels of the window frames as shown. They are provided with vertical T-slots in which strips 23 and 24 of wool pile or the like are mounted for engaging the inner faces of the channels to seal the space between the end rails and the frames.

As shown in FIG. 3, the top rail of each sash is in the form of a downwardly opening channel formed from two metal parts 25 and 26 rigidly connected by a rigid vinyl plastic bar 27. Screws 28 extending through the upper ends of the end rails are screwed into openings in the ends of the top rail to connect the three rails together. A bottom rail for each sash is formed like the other rails from two metal parts 29 and 30 connected by a rigid vinyl plastic bar 31. The ends of the bottom rail are connected by screws 32 (FIGS. 2 and 4) to the end rails. The top and bottom rails carry horizontal strips 33 and 34 of wool pile or the like that engage and slide along the opposing sides of the top and bottom channels of the window frames. Screws 35 extending through the lower ends of the end rails connect them to the bottom rails.

Mounted in the channels of each window sash are a pair of laterally spaced window panes 36, the marginal portions of which fit tightly in a surrounding rubber or soft vinyl plastic channel member 37 pressed tightly into the sash channels.

The outer window sash 11 normally is locked in closed position by a rigid vinyl plastic lever 38 attached at one end to the outer end rail of that sash and extending across into the inner window frame as shown in FIG. 2. This lever has a laterally extending finger 39 provided with a tooth 40 that projects into a notch in flange 6. By flexing the free end of the lever away from the adjacent end of the inner frame, the tooth will be swung out of the notch so that the outer sash can be moved toward the opposite end of the outer frame. However, both sashes normally are locked against movement by means of a spring-pressed latch 41 slidably mounted in a housing 42 attached to the inner end rail of the inner sash. The outer end of the latch projects into a keeper 43 secured to the inner end rail of the outer sash. The inner end of the latch has a handle 44, by which the latch can be pulled out of the keeper so that the window can be opened.

Joined to each overlapping vertical rail, between it and the other window, is a vertical metal bar 46 provided with a pair of vertical slots 47 and 48 separated by a vertical flange 49. The slots face the opposite end of the sash. This bar preferably is integral with the adjoining rail. The outer side wall of outer slot 47; that is, the side nearest the other window, is in the shape of a tapered tongue 50 extending into the slot 47 in the other bar. When the window is closed, the overlapping tongues 50 engage each other and interlock the two bars so that the two window sashes will not be able to move transversely away from each other.

Figure 4:
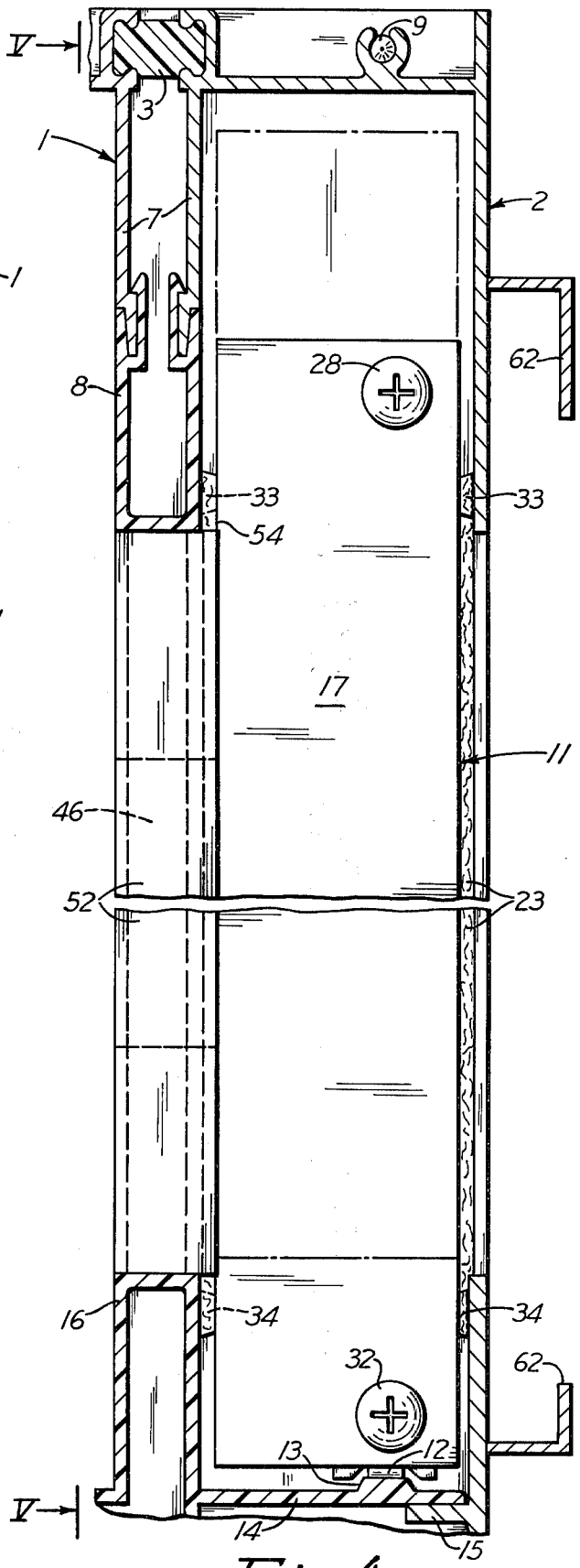

A nonmetallic weather sealing strip 52 is disposed at the side of each metal bar 46 opposite its slots 47 and 48. Each sealing strip is provided with a vertical tongue 53 that extends into the slot 48 in the other bar, with the edge of the flange 49 on that bar pressing against the side of the strip to form a weather seal. The sealing strips are connected to the rails that support them by means of interlocking vertical ribs and grooves so that the adjoining rails and bars 46 can slide vertically along the sealing strips when the windows are being installed or removed from the window frames. For this purpose, as indicated in FIG. 4, bars 46 are shorter than the strips so that a window sash can be raised far enough in the upper channel of the window frame to the dotted-line position, while the sealing strip remains stationary in engagement with upper hollow bar 8 and lower member 16, to permit the bottom of the sash to be swung out of the frame. Then the sash is lowered to remove it from the upper channel as the sash is pulled entirely out of the frame. To insert the sash in the frame, this procedure is reversed.

The overlapping end rails of the sashes carry vertical sealing strips 54 of wool pile or the like that press against the opposing plastic strips 52. Strips 54 slide across the plastic strips when the window is being opened or closed.

Any water or condensation that happens to accumulate in the lower channel of the inner window frame 1 can escape through one of several drain holes 55 in the sill member 14, as shown in FIG. 3. The water will drain into the lower part of the frame, from which it can escape into the lower part of the outer frame through a drain hole 56 in member 14 and then drain out through a hole 57 in the outer side of the outer frame. To prevent wind from blowing back through the drain holes and into the room, a flap valve 58 normally covers the outer side of hole 56. The upper part of this valve has prongs 59 extending rather loosely through a hole 60 in sill member 14 that permits water passing out through hole 56 to push the valve away from the hole far enough for the water to escape. Wind pressure in the opposite direction will force the valve inwardly to its closed position.

The outer window frame may be provided with vertically spaced, horizontal angle bars 62 that from upper and lower channels for receiving a window screen (not shown) that can be slid horizontally into the channels.

According to the provisions of the patent statutues, we have explained the principel of our invention and have illustrated and described what we now consider to represent its best embodiment. However, we desire to have it understood that within the scope of the appended claims, the invention may be practiced otherwise than as specifically illustrated and described.

We claim:

1. A horizontally sliding window comprising a pair of window sash disposed in parallel vertical planes with the right-hand end of one sash overlapping the left-hand end of the other sash when the window is closed, said overlapping ends including vertical sash rails, a vertical metal bar joined to each rail between it and the other sash, each bar having an inner and an outer vertical slot in it separated by a vertical flange and facing the opposite end of the sash that carries the bar, the outer side wall of the outer slot forming a vertical tongue extending into the outer slot in the other bar so that the tongues overlap in engagement with each other to interlock the two bars, and a vertical nonmetallic sealing strip connected to each bar and extending across the flange on the other bar in engagement with that flange to form a seal.

2. A horizontally sliding window according to claim 1, in which the vertical edges of said flanges engage said sealing strips, and the vertical edges of said tongues are spaced from the opposing walls of said outer bar slots.

3. A horizontally sliding window according to claim 1, in which each sealing strip is provided with a vertical tongue extending into the inner slot in the bar facing it, said tongue overlapping the side of the flange on said last-mentioned bar.

4. A horizontally sliding window according to claim 1, in which each sealing strip is mounted on the adjoining bar for vertical movement thereon during installation and removal of said sash, said window including parallel window frames each provided with upper and lower channels receiving the top and bottom of one of said sash, each upper channel being deep enough to permit the sash therein to be raised far enough to allow its bottom to be swung out of the lower channel, said frames substantially engaging the upper and lower ends of the sealing strips, and said bars being enough shorter than the sealing strips to permit said raising of the sash in said upper channel as the bars slide upwardly on said strips.

5. A horizontally sliding window according to claim 1, including a vertical sealing member secured to each of said overlapping end rails and frictionally engaging the sealing strip on the other sash.

6. A horizontally sliding window according to claim 1, in which said sealing strips are rigid vinyl plastic.

7. A horizontally sliding window according to claim 1, in which each sealing strip is rigid plastic provided with a tongue extending into the inner slot in the bar facing it, and each sealing strip is longer than the adjoining bar and is mounted thereon for vertical movement during installation and removal of said sash.

* * * * *